US010561876B2

(12) United States Patent
Chiu

(10) Patent No.: US 10,561,876 B2
(45) Date of Patent: Feb. 18, 2020

(54) BALANCE BEAM GAME APPARATUS

(71) Applicant: Yen-Po Chiu, Taipei (TW)

(72) Inventor: Yen-Po Chiu, Taipei (TW)

( * ) Notice: Subject to any disclaimer, the term of this patent is extended or adjusted under 35 U.S.C. 154(b) by 158 days.

(21) Appl. No.: 15/860,424

(22) Filed: Jan. 2, 2018

(65) Prior Publication Data

US 2019/0201728 A1 Jul. 4, 2019

(51) Int. Cl.
*A63B 4/00* (2006.01)
*A63B 17/04* (2006.01)

(52) U.S. Cl.
CPC ..... *A63B 4/00* (2013.01); *A63B 17/04* (2013.01); *A63B 2208/12* (2013.01); *A63B 2225/09* (2013.01); *A63B 2225/093* (2013.01)

(58) Field of Classification Search
CPC ..... A63F 3/0457; A63F 2003/046; A63F 2003/0465; A63H 33/04; A63H 33/044; A63H 33/06; A63H 33/062; A63H 33/08; A63H 33/082; A63H 33/084; A63H 33/086; A63H 33/088; A63H 33/10; A63H 33/101; A63H 33/105; A63H 33/108; A63B 1/00; A63B 3/00; A63B 4/00; A63B 17/00; A63B 17/04; A63B 26/00; A63B 26/003; A63B 2208/12; A63B 2225/09; A63B 2225/093
See application file for complete search history.

(56) References Cited

U.S. PATENT DOCUMENTS 3,132,443 A * 5/1964 Kuhn ..... A63H 33/044 446/112
3,589,716 A * 6/1971 Footlik ..... A63B 4/00 482/34
4,080,742 A * 3/1978 Osterried ..... A63H 19/30 33/561.2
4,105,201 A * 8/1978 L'Ecuyer ..... A63B 4/00 482/34
4,759,542 A * 7/1988 Hudec ..... A63B 22/14 482/146
5,389,054 A * 2/1995 Dorman ..... A63B 4/00 482/34
6,383,118 B1 * 5/2002 Nestoiter ..... A63B 4/00 482/23
9,126,086 B2 * 9/2015 Howard, II ..... A63B 47/00
2005/0096184 A1 * 5/2005 Shane ..... A63B 4/00 482/34
2013/0095722 A1 * 4/2013 Cochella ..... A63H 33/046 446/85

(Continued)

*Primary Examiner* — Gary D Urbiel Goldner
(74) *Attorney, Agent, or Firm* — Pro-TECHTOR International Services; Ian Oglesby

(57) ABSTRACT

A balance beam game apparatus includes at least a base and at least a combining piece. A surface of the combining piece is an arc-shaped surface and another surface of the combining piece is a horizontal plane. Two ends of the combining piece are provided respectively with a locking slot at a proper location, a connecting slot is disposed above and below the base respectively, and the connecting slot can be latched with the combining piece. A wall on each of two sides of the connecting slot is provided respectively with a locking block which can be selectively latched in the locking slot of the combining piece. Therefore, by combining the abovementioned elements, a game apparatus in all kinds of combinatorial change in routes can be formed.

6 Claims, 4 Drawing Sheets

(56) References Cited

U.S. PATENT DOCUMENTS

| | | | | |
|---|---|---|---|---|
| 2018/0117389 | A1* | 5/2018 | Kao | A63B 21/4034 |
| 2019/0143197 | A1* | 5/2019 | Chiu | A63F 3/0457 273/276 |

* cited by examiner

BALANCE BEAM GAME APPARATUS

BACKGROUND OF THE INVENTION a) Field of the Invention

The present invention relates to a balance beam game apparatus which includes a wood-like combining piece, and more particularly to a game apparatus that is provided with plural styles.

b) Description of the Prior Art

It is known that there are so many kinds and types of game apparatuses on the market and as the conventional game apparatuses are limited to a monotonic design structure, they cannot be combined with one another for use. Therefore, how to choose a game apparatus which can stimulate children to create a fun in exercises and satisfy an autonomous gaming behavior to the children, through the interaction between the learning mode and the game mode, has become a lesson worthy of thinking deeply by the general public and the education industry, which truly requires research, development and innovation.

SUMMARY OF THE INVENTION

The primary object of the present invention is to provide a balance beam game apparatus which includes a wood-like combining piece, with two ends of the combining piece being provided at least with a locking slot at a proper location. The abovementioned combining piece is latched on a base, with a connecting slot on an upper and lower end of the base being provided respectively with a locking block selectively latched in the locking slot of the combining piece. Thus, the abovementioned elements can be assembled into a game apparatus in all kinds of combinatorial change in routes, depending upon the needs of the children.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
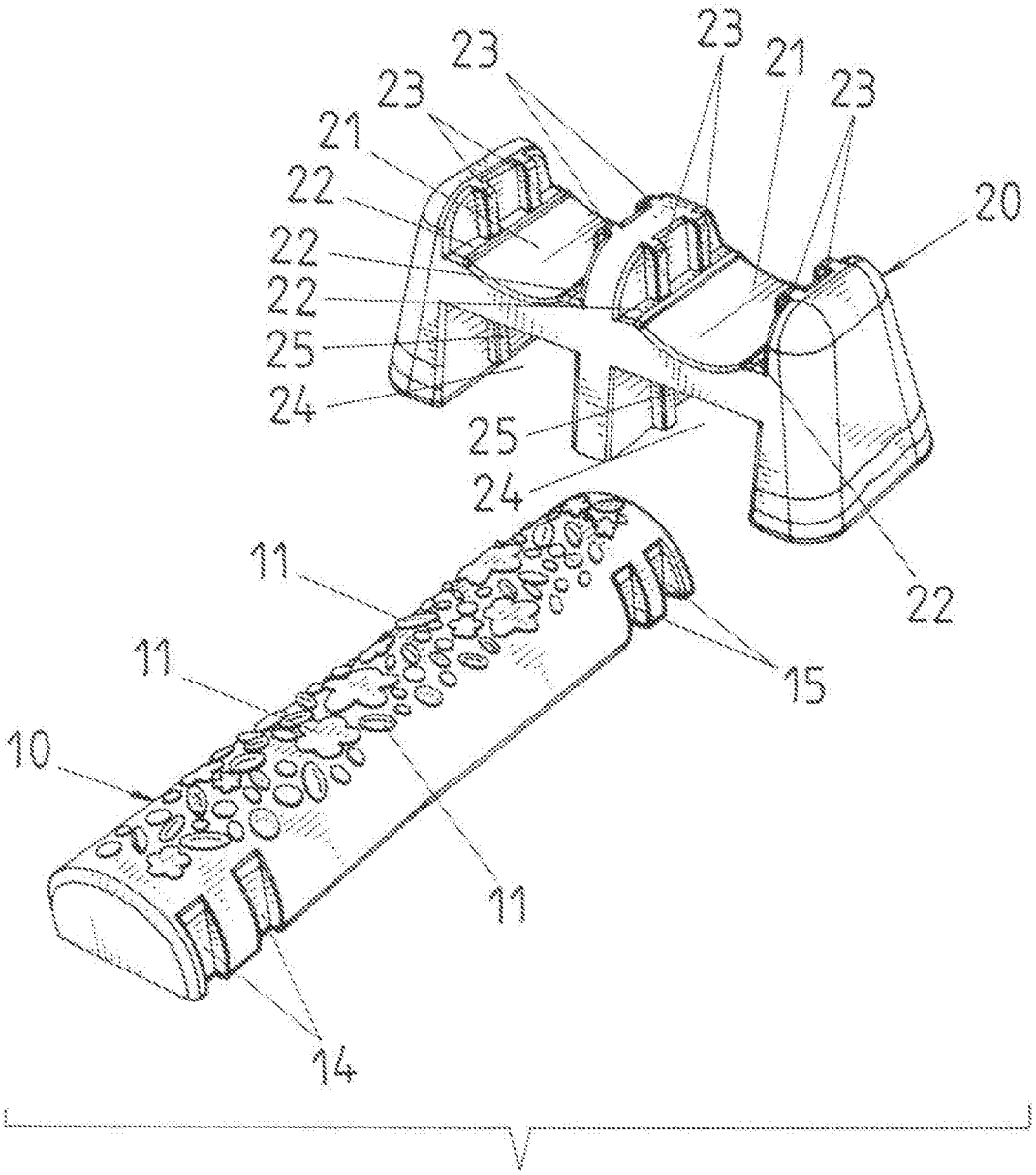
FIG. 1 shows a structural exploded view of the present invention.
Figure 2:
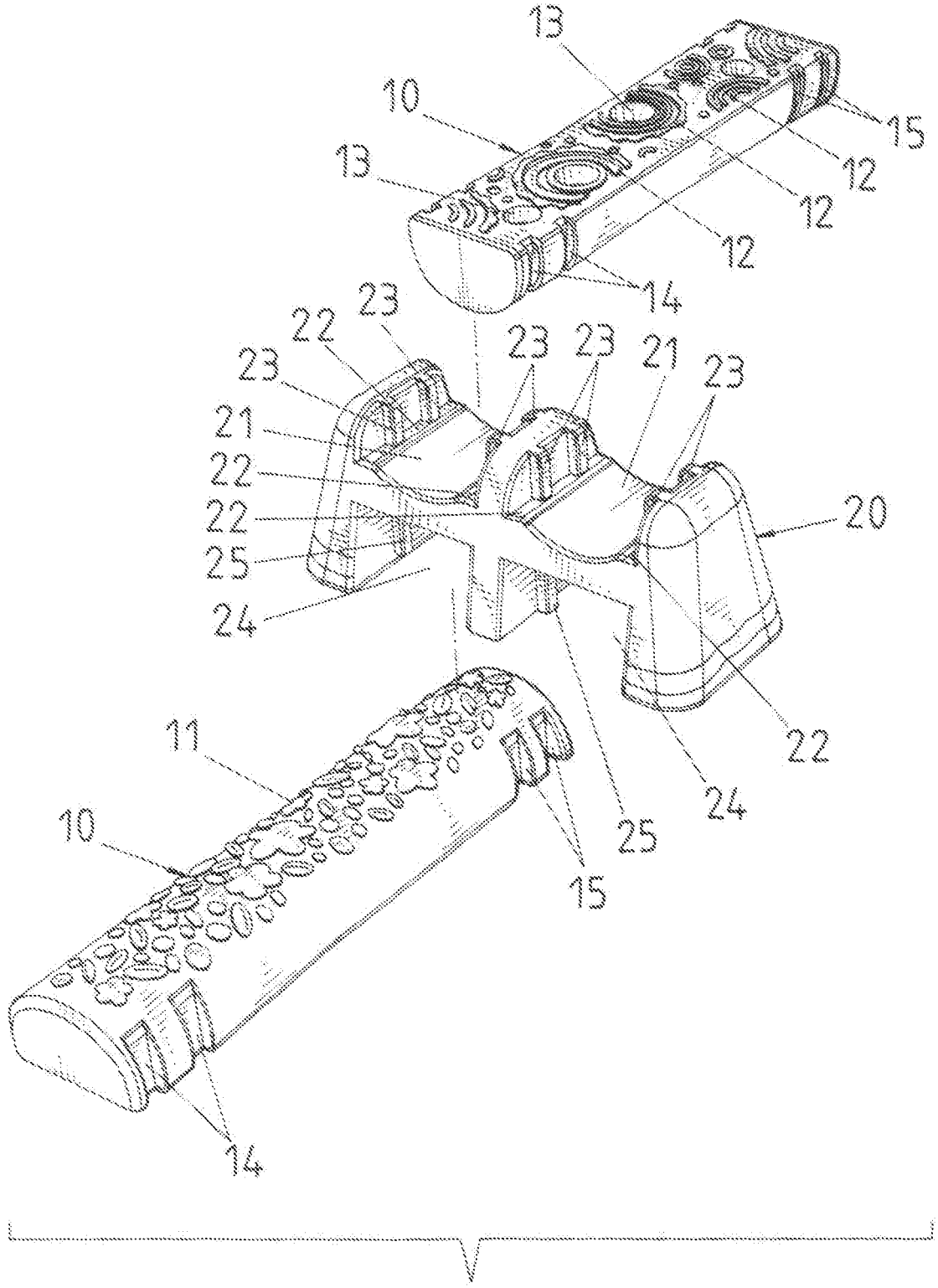
FIG. 2 shows another structural exploded view of the present invention.

Referring to FIG. 1 and FIG. 2, a balance beam game apparatus of the present invention is formed by at least a combining piece 10 and at least a base 20, wherein the combining piece 10 is in a shape of wood, a surface of the combining piece 10 is in an arc shape and the other surface of the combining piece 10 is a horizontal plane. The arc-shaped surface of the combining piece 10 is filled with all kinds of non-skid bulges 11 in styles and patterns, so as to prevent from skidding when children step on the bulges 11. The horizontal plane of the combining piece 10 is also filled with all kinds of non-skid stripes 12 in styles and patterns and at least a cavity 13 for climbing. Two ends of the combining piece 10 are provided respectively with a locking slot 14, 15 at a proper location, and the locking slots 14, 15 are in a long rectangular shape.

Above the base 20 is provided at least with a connecting slot 21, and below the base 20 is also provided at least with a connecting slot 24. The upper connecting slot 21 is in a U-shape and a bottom of the upper connecting slot 21 is in an arc shape; whereas, the lower connecting slot 24 is in an inverted-U shape. A wall on each of two sides of the upper connecting slot 21 above the base 20 is provided respectively with a locking block 23 in a long rectangular shape. The locking block 23 is extended with a horizontal plane 22 on a lower side and is then connected downward to a bottom of the connecting slot 21. A wall on each of two sides of the connecting slot 24 below the base 20 is also provided respectively with a locking block 25 in a long rectangular shape.

When the combining piece 10 is disposed in the connecting slot 21 of the base 20 with the horizontal plane, a bottom on the horizontal plane of the combining piece 10 is disposed flat on two horizontal planes 22 of the connecting slot 21 of the base 20. In association with the combining piece 10 on the top portion in FIG. 2, when the combining piece 10 is flipped upside down, so that another arc-shaped surface is used as a bottom surface, a bottom of the arc-shaped surface of the combining piece 10 is disposed at an arc-shaped bottom of the connecting slot 21 above the base 20.

Figure 3:
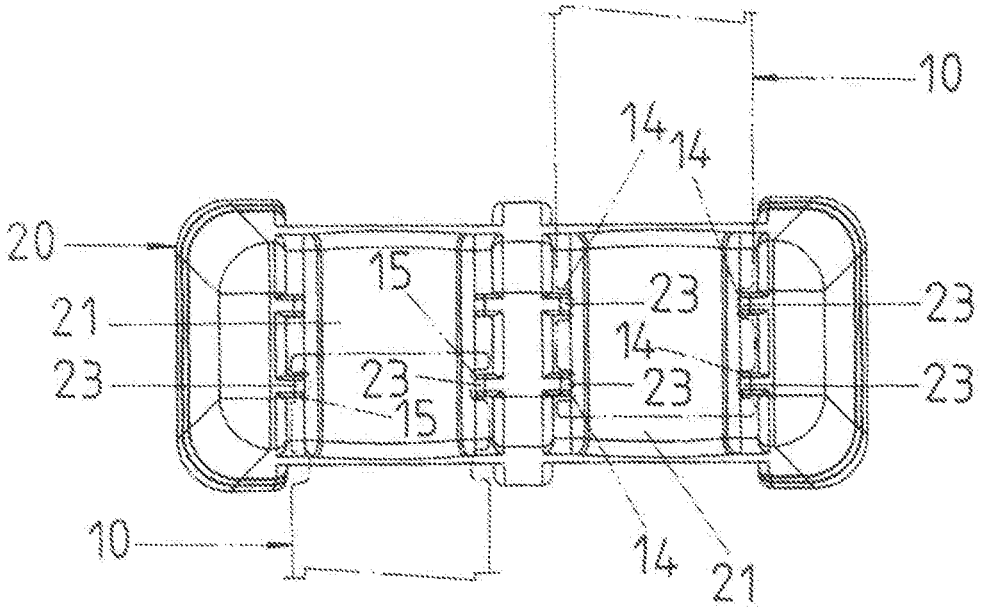
FIG. 3 shows a top plan cross-sectional view of the present invention.

Referring to FIG. 3, it shows a left side view of the present invention. A locking block 23 on one of two sides of the connecting slot 21 above the base 20 is latched respectively in a locking slot 15 on one of two sides of the combining piece 10; Referring to FIG. 3, it shows a right side view of the present invention. whereas, two locking blocks 23 on two sides of the connecting slot 21 above the base 20 are latched respectively in two locking slots 14 on two sides of the combining piece 10.

Figure 4:
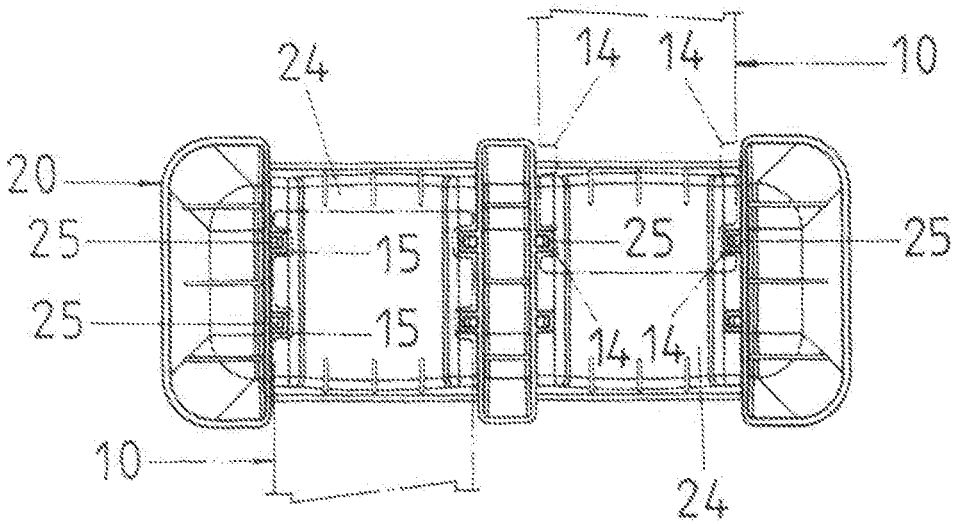
FIG. 4 shows a bottom plan cross-sectional view of the present invention.

Referring to FIG. 4, it shows a left side view of the present invention. two locking blocks 25 on two sides of the connecting slot 24 below the base 20 are latched respectively in two locking slots 15 on two sides of the combining piece 10; Referring to FIG. 4, it shows a right side view of the present invention. whereas, a locking block 25 on one of two sides of the connecting slot 24 below the base 20 is latched respectively in a locking slot 14 on one of two sides of the combining piece 10.

Figure 5:
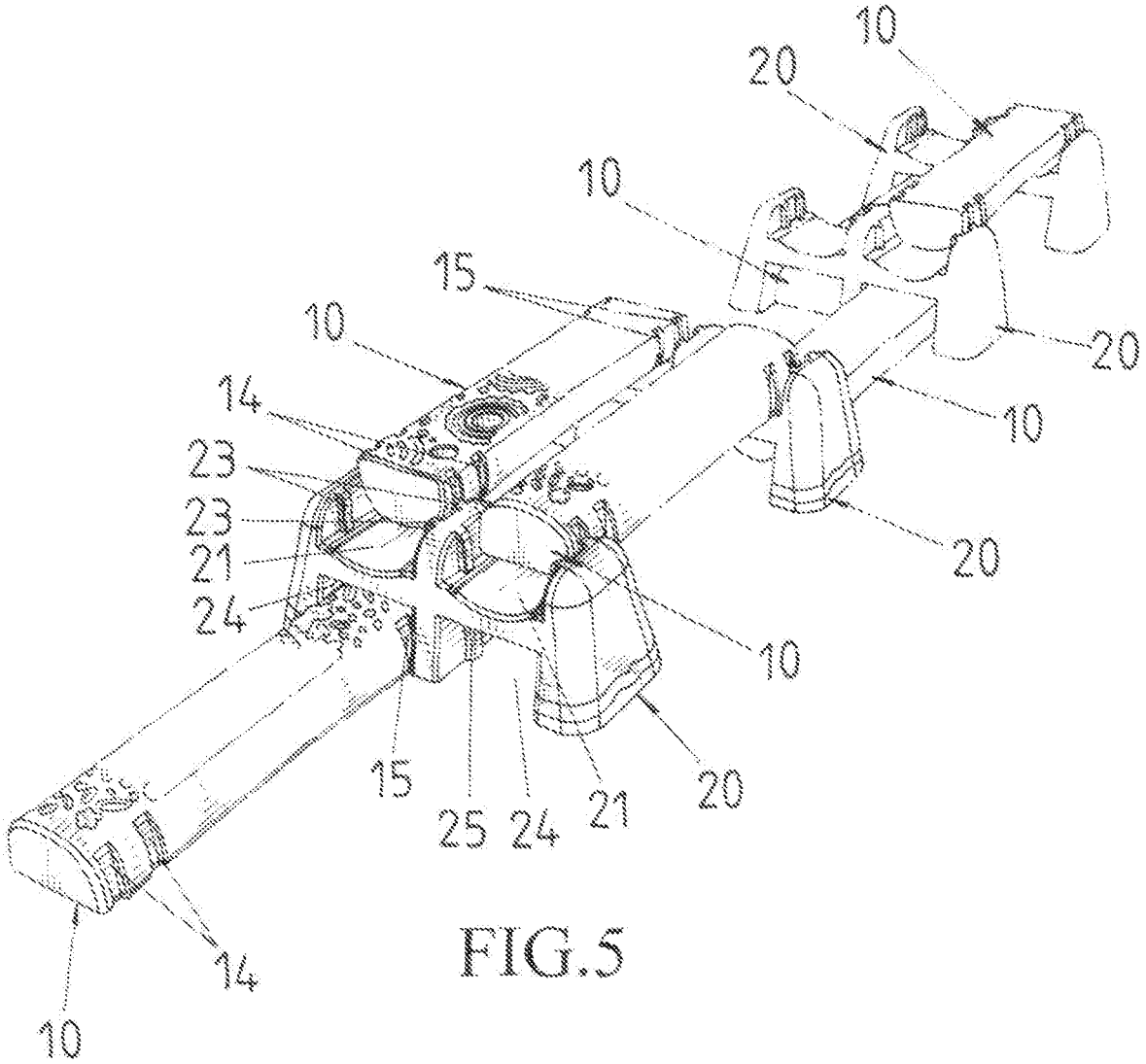
FIG. 5 shows a structural schematic view of assembly of the present invention.

Referring to FIG. 5, it shows a schematic view of assembly that plural bases 20 are fitted with plural combining pieces 10. In addition to that the combining pieces 10 are latched in the connecting slots 21 above the bases 20 with the arc-shaped surfaces or the horizontal planes as bottom surfaces, the combining pieces 20 can be also latched in the connecting slots 24 below the bases 20 with the arc-shaped surfaces or the horizontal planes as top surfaces, thereby being assembled into game apparatuses in all kinds of shapes.

In light of above, and in accordance with the above description of the embodiments, a balance beam game apparatus of the present invention can be very fun and can be played with in many different ways.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A balance beam game apparatus comprising: a combining piece having an arc-shaped surface opposite a planar horizontal surface, and a plurality of locking slots substantially vertically disposed at each of two opposing ends of the combining piece; and a base having an upper connecting slot opposite a lower connecting slot, a bottom of the upper connecting slot and a top of the lower connecting slot providing for a selective engagement with the arc-shaped surface or the planar horizontal surface of the combining piece, the upper connecting slot and the lower connecting slot each comprising a plurality of locking blocks substantially vertically disposed at each of two spaced apart upright walls, the plurality of locking blocks being selectively and respectively latched in the plurality of locking slots of the combined piece; wherein the bottom of the upper connecting slot comprises two spaced apart horizontal planes respectively adjacent to lower edges of the two spaced apart upright walls of the upper connecting slot, the plurality of locking blocks of the upper connecting slot respectively extending substantially vertically from the two spaced apart horizontal planes and along the respective spaced apart upright walls of the upper connecting slot.

2. The balance beam game apparatus according to claim 1, wherein the arc-shaped surface of the combining piece comprises non-skid bulges having styles and/or patterns.

3. The balance beam game apparatus according to claim 1, wherein the planar horizontal surface of the combining piece comprises non-skid stripes having styles and/or patterns and at least a cavity for climbing.

4. The balance beam game apparatus according to claim 1, wherein the plurality of locking slots of the combining piece are in a long rectangular shape.

5. The balance beam game apparatus according to claim 1, wherein the plurality of locking blocks of the base are in a long rectangular shape.

6. The balance beam game apparatus according to claim 1, wherein the bottom of the upper connecting slot has an arced shape between and connecting the two spaced apart horizontal planes.

* * * * *